United States Patent [19]

Wiener

[11] Patent Number: 5,052,755

[45] Date of Patent: Oct. 1, 1991

[54] CHAIR, AND METHODS OF CONSTRUCTING AND UTILIZING SAME

[75] Inventor: Hattie Wiener, New York, N.Y.

[73] Assignee: Hattie Enterprises, Inc., New York, N.Y.

[21] Appl. No.: 558,159

[22] Filed: Jul. 25, 1990

[51] Int. Cl.[5] ..... A47C 7/90

[52] U.S. Cl. ..... 297/452; 297/284; 297/460

[58] Field of Search ..... 297/452, 460, 284; 128/44

[56] References Cited

U.S. PATENT DOCUMENTS

| | | | |
|---|---|---|---|
| 1,527,754 | 2/1925 | Simon | 297/284 X |
| 3,196,868 | 7/1965 | Johnston | 297/284 X |
| 3,606,464 | 9/1971 | Arbuthnot | 297/460 |
| 4,489,982 | 12/1984 | Morrow | 297/284 X |
| 4,647,066 | 3/1987 | Walton | 297/284 X |
| 4,732,423 | 3/1988 | Condon | 297/284 |
| 4,911,502 | 3/1990 | Gorman | 297/460 |

*Primary Examiner*—Peter A. Aschenbrenner

*Attorney, Agent, or Firm*—Irving M. Weiner; Pamela S. Burt; Robert M. Petrik

[57] ABSTRACT

A chair for naturally supporting a user's body in an erect sitting posture. The frame of the chair supports a specially-constructed seat portion which cooperates with a back support portion to normally and comfortably maintain an erect sitting posture. The back support portion includes a pair of lower support members which contact the user's back at spaced-apart points below the waist, and a pair of upper support members which contact the user's back at spaced apart points above the waist. The seat portion is constructed to normally urge the user's body into confortable contact with the back support members.

22 Claims, 2 Drawing Sheets

CHAIR, AND METHODS OF CONSTRUCTING AND UTILIZING SAME

BACKGROUND OF THE INVENTION

1. Field of the Invention

The present invention relates generally to a chair adapted to support the user in an erect sitting posture. More particularly, the invention relates to a chair having back supporting portions for exerting pressure at particular points on the user's back, the back supporting portions cooperating with a specially-designed seat portion to ensure that a person sitting on the chair will maintain an erect sitting posture.

2. Description of Relevant Art

Conventional chair constructions typically permit and even encourage a user to sit in a slouched or non-erect position. Because an ongoing conscious effort is required to maintain an erect sitting posture, the user is likely to spend more time in a slouched or non-erect sitting posture than an erect one. For the vast number of people who spend the majority of their waking hours in a seated position, conventional chairs fail to offer the desirable advantage of maintaining an erect sitting posture without requiring a conscious effort to do so.

Stress to the back and other parts of the body is an inevitable consequence of sitting in a slouched or non-erect position for any length of time. Where a poor sitting posture is maintained on a routine basis, long-term back, neck and other problems are likely to result.

The present invention overcomes the foregoing difficulties encountered with conventional chair constructions by supporting a user's body in a way which naturally encourages an erect sitting posture. Unlike other chairs, the novel back support and seat portions of the chair according to the invention cooperate to maintain the user's body in an erect and healthy sitting posture without requiring any conscious effort on the user's part to monitor and/or properly orient his or her body.

SUMMARY OF THE INVENTION

The present invention provides a chair adapted to support a user's body in an erect sitting posture, including a frame having leg members for supporting the chair on a horizontal surface, a seat portion supported on the frame, and a back support portion mounted on the frame rearwardly of the seat portion. The back support portion includes means for applying pressure only to predetermined spaced-apart portions of a user's back. The seat portion is adapted to orient the user's body such that the user's back is normally urged to comfortably contact the pressure applying means. The seat portion and the pressure applying means cooperate to normally maintain the user's body in an erect sitting posture.

In a preferred embodiment, the back support portion includes first means for applying pressure only to predetermined spaced apart portions of a user's back below the user's waist, and second means for applying pressure only to predetermined spaced apart portions of a user's back above the user's waist. The first pressure applying means comprises a pair of spaced-apart lower balls, and the second pressure applying means comprises a pair of spaced-apart upper balls. The upper balls are spaced apart further in the width direction of the chair than the lower balls, and the upper balls are supported in a vertical plane which is slightly closer to the front of the chair than the vertical plane in which the lower balls are disposed.

The seat portion preferably has a front to back dimension which is sufficiently small that a user seated in the chair will sense that he/she is sliding forwardly off the chair if he/she shifts to a slouched or non-erect position. The seat portion is preferably supported by the frame such that the rear edge of the seat portion is disposed in a vertical plane which is closer to the front of the chair than the vertical plane containing the upper balls, such that a space is defined between the rear edge of the seat and the back portion.

In another embodiment of the invention, the leg members of the chair are replaced by a pedestal base support structure on which the seat portion is pivotally supported, so as to define a swivel chair embodiment of the invention.

A principal object of the invention is to provide a chair which promotes a healthy sitting posture by naturally supporting the user's body in an erect sitting position.

A further object of the invention is to provide a chair of simple construction which is aesthetically pleasing, and which at the same time promotes a healthy erect sitting posture so as to eliminate back strain.

The above and further objects, details and advantages of the invention will become apparent from the following detailed description, when read in conjunction with the accompanying drawings.

DETAILED DESCRIPTION OF PREFERRED EMBODIMENTS

Figure 1:
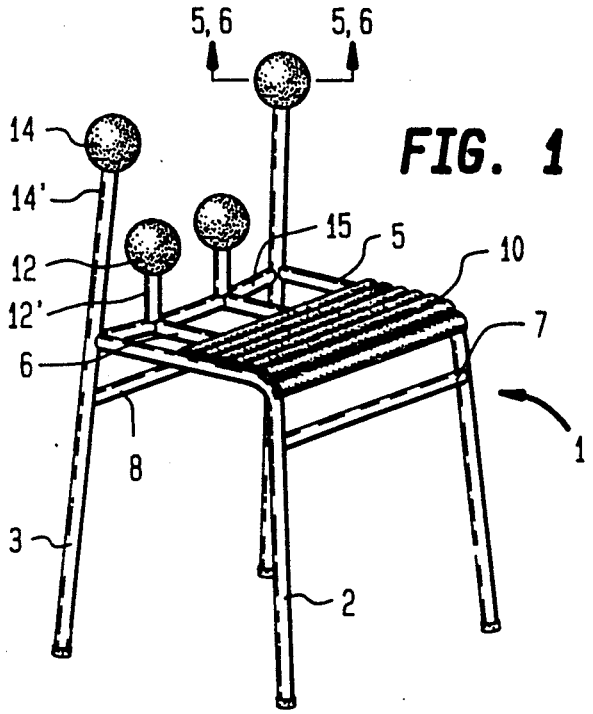
FIG. 1 is a perspective view of a first embodiment of the chair according to the invention.
Figure 2:
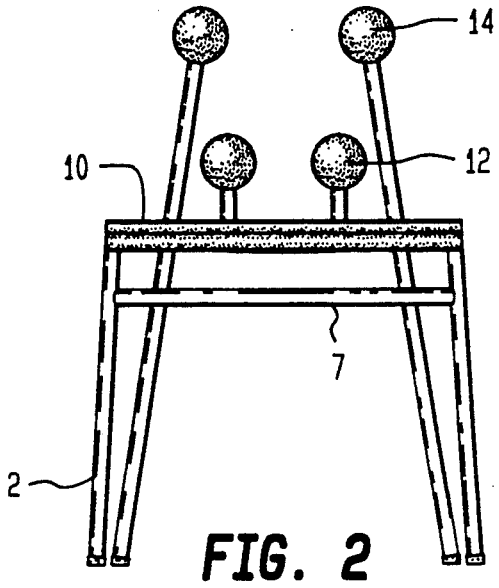
FIG. 2 is a front elevational view of the chair of FIG. 1.
Figure 3:
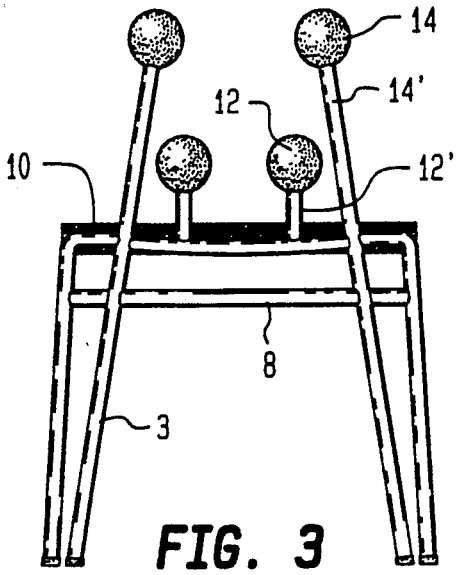
FIG. 3 is a rear elevational view of the chair of FIG. 1.

With reference to FIG. 1–4, a chair according to the invention includes a frame indicated generally by reference numeral 1. The frame 1 includes a pair of front legs 2 and a pair of rear legs 3 for supporting the chair on a floor or other horizontal surface. The frame 1 is preferably constructed of sturdy rigid material, such as for example, metal. The construction of the legs 2, 3 may be modified as desired, and is not limited to the four-leg construction shown. If desired, a pair of cross-supports may extend between the respective legs 2, 3, a front cross-support 7 may extend between the respective front legs 2, and a rear cross-support 8 may extend between the rear legs 3.

Each of the front legs 2 of the chair is bent at substantially a right angle to define a substantially horizontal seat support frame portion 5. A pair of additional seat support frame portions 6, and/or other seat-supporting frame portions, may be provided as needed to afford necessary support for the seat 10.

It is to be understood that the construction of frame 1 may be modified as desired, without departing from the spirit or scope of the invention.

The seat portion 10 is preferably constructed such that the upper surface thereof may be defined by a connected series of semi-cylindrical portions as shown. To this end, the seat 10 may have a one-piece construction, or alternatively may be formed of a series of half-tubes arranged contiguously to one another. Preferably, the seat 10 is fabricated of hard rubber, metal or a similiar material which tends to prevent the user's body from sliding relative thereto.

The front legs 2 may be spaced slightly apart in the width direction than the rear legs 3, as shown, so that the seat portion 10 supported thereon is slightly inwardly tapered in the rearward direction to define a substantially trapezoidal shape in plan. However, the arrangement of legs 2, 3 and seat portion 10 is not limited to such configuration.

The back support portion of the chair is defined by first means for independently supporting two portions of a user's back on either side of the spine in the posterior pelvic area, and second means for independently supporting two separate portions of a user's back on either side of the spine in the thoracic area. The first means takes the form of a pair of spaced-apart lower spherical members or balls 12, and the second means takes the form of a pair of spaced-apart upper spherical members or balls 14.

The lower balls 12 are supported on upwardly extending frame portions 12', while the upper balls 14 are supported on upwardly extending frame portions 14'. A rear frame cross-member 15 is connected to the rear ends of frame members 6, and near the intersection of frame members 3, 5, so as to support frame portions 12'. The frame portions 14' for supporting upper balls 14 may desirably, but not necessarily, comprise integral upward extensions of rear legs 3 as shown.

Figure 4:
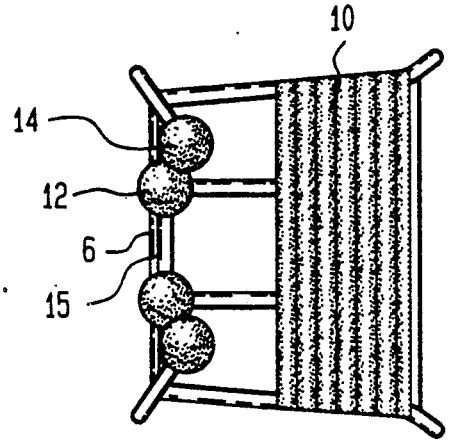
FIG. 4 is a top plan view of the chair of FIG. 1.

With reference to FIG. 4, the upper balls 14 are spaced apart a greater distance than the lower balls 12 such that both balls 12 are disposed inwardly of balls 14 in the widthwise direction of the chair. The upper balls 14 are also disposed in a vertical plane which is very slightly closer to the front of the chair than the vertical plane containing lower balls 12 (i.e., the upper balls 14 and lower balls 12 are almost co-planar), as shown in FIG. 4. To this end, the frame legs or members 3 are inclined somewhat towards the front of the chair from their bottoms to their tops. It is further contemplated that the orientation of the lower balls 12 and upper balls 14 may be adjustable by the user in the front-to-back direction, so that the user can adjust the relative positions of same to conform comfortably to the user's body in a sitting posture.

Figure 5:
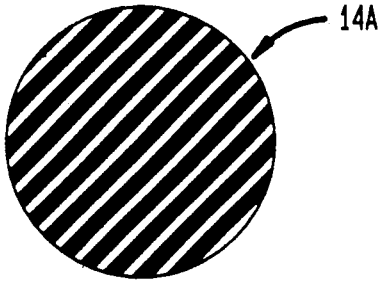
FIG. 5 is a view taken along line 5—5 in FIG. 1, showing a first embodiment of a back support member.
Figure 6:
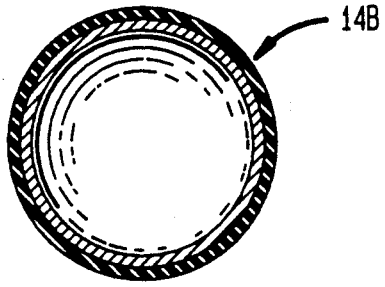
FIG. 6 is an alternative view taken along line 6—6 in FIG. 1, showing a second embodiment of a back support member.

FIGS. 5 and 6 show two alternative constructions for the balls 14, which are equally applicable to balls 12. In FIG. 5 the ball 14A is formed of solid rubber, while in FIG. 6 the ball 14B is formed of a metal sphere with an outer rubber covering. The upper balls 14 and lower balls 12 may be formed according to either construction. Other constructions for the back support members are also contemplated, although preferably the members will each have a curved resilient surface for contacting the user's back.

A space is defined between the rear edge of seat 10 and frame member 15 as shown in FIGS. 1 and 4. The width of seat 10 may be approximately 16 inches. The overall front to back dimension of the seat portion, from the front of seat 10 to frame member 15, is preferably approximately 15 inches, the front to back dimension of seat 10 being approximately 9 inches and the front to back dimension of the space behind seat 10 being approximately 6 inches. The seat portion thus has a front to back dimension which is sufficiently small that a user seated in the chair will sense that he/she is slidingly forward off the seat if he/she sits in a slouched or non-erect position. When seated properly erect, the user will be comfortably accommodated by the seat portion.

The lower balls 12 are elevated a predetermined distance above the seat portion so as to contact the user's back at spaced-apart points below the waist, while the lower balls 14 are elevated a predetermined distance so as to contact the user's back at spaced-apart points above the waist. To this end, the supports 12' support lower balls 12 at a distance approximately 4 inches above the seat portion, while the supports 14' support upper balls 14 at a distance approximately 14.5 inches above the seat portion, or approximately 32 inches from the floor. Preferably, the diameter of each of the balls 12 and 14 is approximately 3 inches.

With the chair construction as shown and described, the user's body will be naturally and comfortably supported in an erect sitting posture due to the cooperating seat and back portions. Unlike conventional chairs, the chair according to the invention promotes an erect sitting posture. The user need not consciously maintain an erect posture since the chair according to the invention will naturally encourage same.

The design of the chair in accordance with the invention naturally supports the user's body in an erect sitting posture. The spaced apart back supports 12, 14 are arranged to contact the user's back at two points below the waist and two points above the waist, with the upper supports 14 being arranged closer to the front of the chair than lower supports 12. This arrangement of supports 12, 14 provides for the application of pressure to the user's back in a manner which will naturally maintain an erect sitting posture.

When the user is properly positioned with his/her back supported below and above the waist by balls 12 and 14, respectively, the seat 10 will comfortably support him/her. Should the user shift to a slouched or non-erect position, the relatively shallow seat 10 will fail to provide comfortable support, causing the user to sense that he/she is sliding off the chair. The construction of seat 10 thus cooperates with back support balls 12 and 14 to naturally maintain an erect sitting posture to thereby reduce strain to the back and other body parts.

Figure 7:
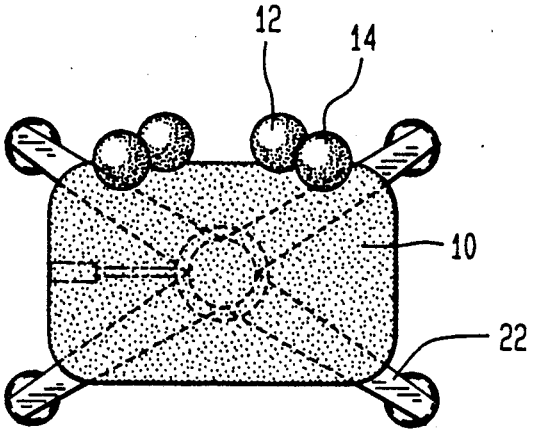
FIG. 7 is a top plan view of a chair according to a second embodiment of the invention.
Figure 8:
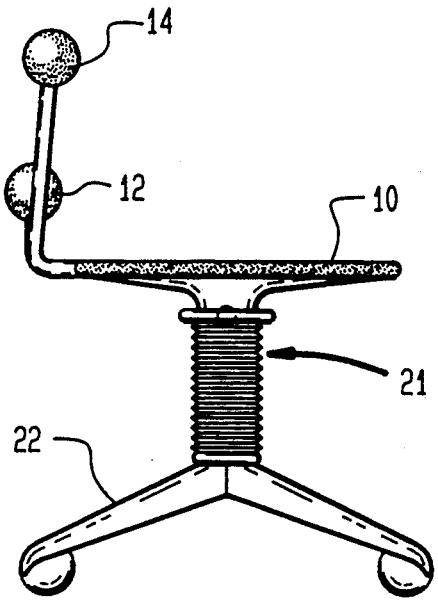
FIG. 8 is a side elevational view of the chair of FIG. 7.
Figure 9:
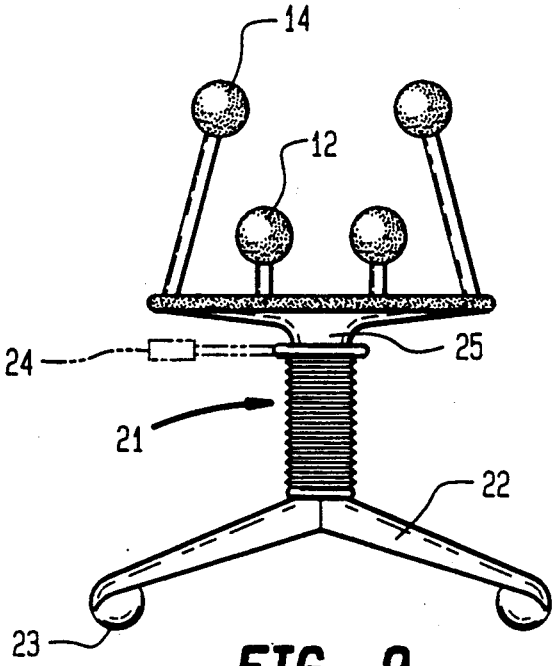
FIG. 9 is a front elevational view of the chair of FIG. 7.

An alternative swivel-chair embodiment of the invention is shown in FIGS. 7–9. In this embodiment, the chair legs 2, 3 are replaced by a pedestal base or support 20, while the remainder of the frame, the seat portion 10 and the back support portion including lower and upper balls 12, 14 remain substantially the same as described above.

The pedestal base 20 includes a central substantially vertical support 21 having the upper end thereof rigidly affixed to suitable bracket means 25 provided at the lower side of seat portion 10. The lower end of support 21 is supported by a plurality (e.g., four) of base legs 22 joined at a common central circular cuff member for receiving the lower end of support 21. The base legs 22 are in turn provided with casters 23, respectively, to permit convenient movement of the chair across a floor surface. The support 21 is adapted to permit pivotal or swivel movement of seat portion 10 in a known manner, such as by having the lower end of support 21 rotatably supported in the cuff joining base legs 22.

The swivel chair embodiment of the invention shown n FIGS. 7–9 may be provided with seat height adjusting means for permitting convenient height adjustment of seat portion 10 relative to the floor. The seat height adjusting means may, for example, take any one of the known forms commonly used for office or secretarial swivel chairs or bar stool. By way of example, in FIG. 9 a lever 24 is shown for operating a well known pneumatic seat-height adjusting means in which vertical support 21 may be defined by a cylinder and rod. The seat height is adjusted merely by operating the lever 24 and lifting the seat portion 10 up or pressing it down.

The swivel chair embodiment of the invention is suitable for use as an office or secretarial chair, or in any other application where a swivel chair is convenient for use. To this end, the height adjustment means may be adapted to permit elevating seat portion 10 to a height at which the chair can serve as a bar stool, for example. Alternatively, the vertical support 21 may have a fixed elevated height.

While there have been disclosed what are at present considered to be the preferred embodiments of the invention, it will be understood that various modifications may be made therein without departing from the spirit or scope of the invention. The present embodiments are therefore to be understood as illustrative, and not restrictive. The scope of the invention is indicated by the appended claims.

I claim:

1. A chair adapted to support a user's body so as to control sitting posture, comprising:

a frame including leg members for supporting the chair on a horizontal surface;

a seat portion supported on said frame;

a back support portion mounted on said frame rearwardly of said seat portion;

said back support portion including first means for independently supporting two separate portions of a user's back, on either side of the spine, in the posterior pelvic area; and said back support portion further including second means for independently supporting two separate portions of a user's back, on either side of the spine, in the thoracic area.

2. A chair according to claim 1, wherein:

said first support means comprises a pair of spaced-apart lower back support members, and said second support means comprises a pair of spaced-apart upper back support members; and said upper back support members are arranged in a vertical plane which is closer to the front of said chair than the vertical plane containing said lower back support members.

3. A chair according to claim 2, wherein:

each of said upper and lower back support members comprise curved surfaces adapted to contact the user's back.

4. A chair according to claim 3, wherein:

each of said upper and lower back support members is substantially spherical and mounted to said frame by a substantially vertically extending frame member.

5. A chair according to claim 4, wherein:

said frame members supporting said upper back support members comprise integral upward extensions of a pair of rear ones of said leg members.

6. A chair according to claim 2, wherein:

said seat portion has a front to back dimension which is sufficiently small that a user seated in said chair will sense that he/she is sliding forwardly off said chair unless he/she sits in a position in which his/her back is in contact with said upper and lower back support members.

7. A chair according to claim 6, wherein:

said frame supports said seat portion such that the rear edge of said seat portion is disposed in a vertical plane which is closer to the front of said chair than said vertical plane containing said upper back support members, so that a space is defined between said rear edge of said seat portion and said back support portion.

8. A chair according to claim 6, wherein:

said front to back dimension of said seat portion is approximately nine inches, and said seat portion is substantially horizontal.

9. A chair according to claim 7, wherein:

said front to back dimension of said seat portion is approximately nine inches, and the front to back dimension of said space defined rearwardly of said seat portion is approximately six inches.

10. A chair according to claim 9, wherein:

said upper back support members are elevated approximately nine to fifteen inches above said seat portion; and said lower back support members are elevated approximately four inches above said seat portion.

11. A chair according to claim 2, wherein:

said vertical plane containing said upper back support members is approximately one inch closer to the front of said chair than the vertical plane containing said lower back support members.

12. A chair according to claim 4, wherein:

said spherical back support members have a diameter of approximately three inches and are fabricated of rubber;

said seat portion is fabricated of rubber; and said frame is fabricated of metal.

13. A chair according to claim 6, wherein:

said seat portion has an upper surface formed by a continuous series of semi-cylindrical portions.

14. A chair adapted to support a user's body so as to control sitting posture, comprising:

a frame including leg members for supporting the chair on a horizontal surface;

a seat portion supported on said frame;

a back support portion mounted on said frame rearwardly of said seat portion;

said back support portion including first means for independently supporting two separate portions of a user's back, on either side of the spine, in the posterior pelvic area, and second means for independently supporting two separate portions of a user's back, on either side of the spine, in the thoracic area;

said first support means comprises a pair of lower balls and said second support means comprises a pair of upper balls;

said upper balls are supported in a vertical plane which is closer to the front of said chair than a vertical plane in which said lower balls are disposed; and said upper balls are spaced further apart in a widthwise direction of said chair than said lower balls.

15. A chair according to claim 14, wherein:

said seat portion has a front to back dimension which is sufficiently small that a user seated in said chair will sense that he/she is sliding forwardly off said chair unless he/she sits in a position in which his/her back is in contact with said upper and lower balls.

16. A chair according to claim 15, wherein:

said frame supports said seat portion such that the rear edge of said portion is disposed in a vertical plane which is closer to the front of said chair than said vertical plane containing said upper balls, so that a space is defined between said rear edge of said seat and said back support portion; and said front to back dimension of said seat portion and the front to back dimension of said space defined rearwardly of said seat portion together amount to approximately eighteen inches.

17. A chair according to claim 16, wherein:

said frame is formed of metal and said seat portion and said balls are formed of rubber.

18. A chair according to claim 17, wherein:

the distance from a horizontal surface supporting said chair to said upper balls is approximately twenty-seven to thirty-two inches.

19. A chair adapted to support a user's body so as to control sitting posture, comprising:

a pedestal base adapted to pivotably support the chair on a horizontal surface;

a seat portion supported by a frame and mounted on said pedestal base;

a back support portion mounted on said frame rearwardly of said seat portion; and said back support portion including first means for independently supporting two separate portions of a user's back, on either side of the spine, in the posterior pelvic area, and second means for independently supporting two separate portions of a user's back, on either side of the spine, in the thoracic area.

20. A chair according to claim 19, wherein:

said pedestal base including seat height adjusting means for selectively raising and lowering the height of said seat portion.

21. A chair according to claim 19, wherein:

said first support means comprises a pair of spaced-apart lower back support members, and said second support means comprises a pair of spaced-apart upper back support members; and said upper back support members are arranged in a vertical plane which is closer to the front of said chair than the vertical plane containing said lower back support members.

22. A chair according to claim 21, wherein:

said seat portion has a front to back dimension which is sufficiently small that a user seated in said chair will sense that he/she is sliding forwardly off said chair unless he/she sits in a position in which his/her back is in contact with said upper and lower back support members.

* * * * *